US007902733B2

(12) United States Patent
Posey

(10) Patent No.: US 7,902,733 B2
(45) Date of Patent: Mar. 8, 2011

(54) UNIQUELY DESIGNED INTERNAL COMBUSTION ENGINE SPARK PLUG THAT WILL PRODUCE TWO INDEPENDENT IGNITION SPARKS BETWEEN THE SPARK PLUG ELECTRODES FOR EACH SINGLE ELECTRICAL IGNITION COIL DISCHARGE

(76) Inventor: Thad Whitfield Posey, Warrenton, VA (US)

( * ) Notice: Subject to any disclaimer, the term of this patent is extended or adjusted under 35 U.S.C. 154(b) by 417 days.

(21) Appl. No.: 11/974,593

(22) Filed: Oct. 16, 2007

(65) Prior Publication Data

US 2009/0096345 A1 Apr. 16, 2009

(51) Int. Cl.
*H01T 13/20* (2006.01)

(52) U.S. Cl. ..... 313/141

(58) Field of Classification Search ..... 313/145, 313/141–142

See application file for complete search history.

(56) References Cited

U.S. PATENT DOCUMENTS 2,946,912 A * 7/1960 Christenson ..... 313/141
3,870,918 A * 3/1975 Senda et al. ..... 313/131 R
4,087,719 A * 5/1978 Pratt, Jr. ..... 315/45
5,821,675 A * 10/1998 Suzuki ..... 313/123

* cited by examiner

*Primary Examiner* — Toan Ton
*Assistant Examiner* — Hana S Featherly

(57) ABSTRACT

This invention is an improvement to the internal combustion engine spark plug used to ignite the fuel air mixture in the engine combustion chamber. All spark plugs manufactured today produce one ignition spark for each high voltage electrical discharge of the ignition coil regardless of the number of spark plug electrodes used in the manufacture of the spark plug. This invention uses an intermediate electrically neutral electrode placed between the spark plug center electrode and the ground strap electrode creating two separate spark air gaps. For each single high voltage electrical discharge of the ignition coil, a spark will occur between the center electrode and the intermediate electrode and another distinct and separate spark will occur between the intermediate electrode and the ground strap electrode. Because the two ignition sparks are electrically in series, both will have the same electrical energy.

6 Claims, 1 Drawing Sheet

(Fig 1)
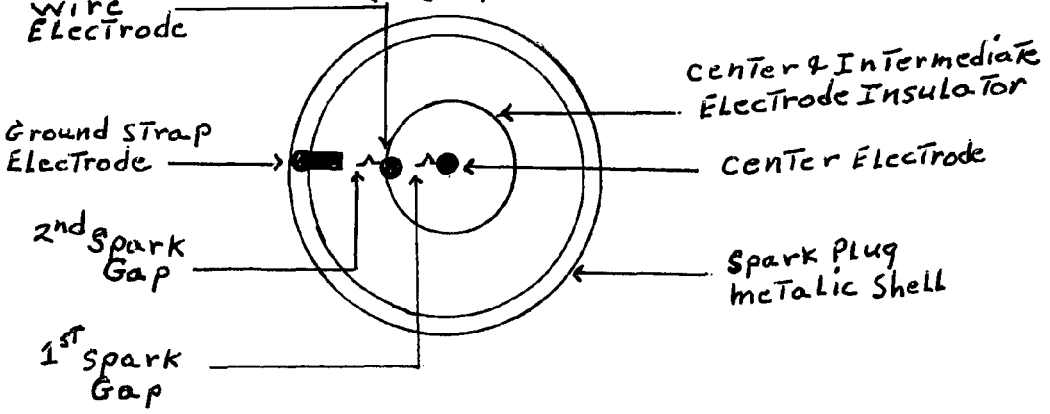
(Fig 2)
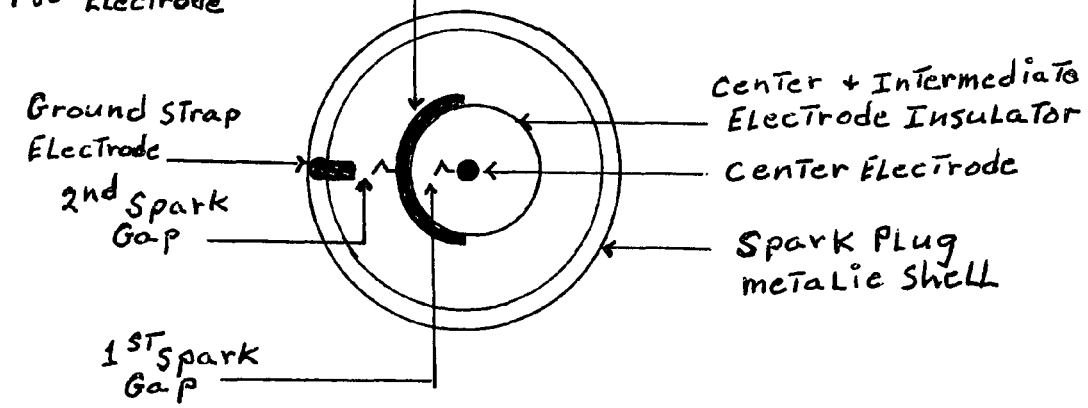
(Fig 3)
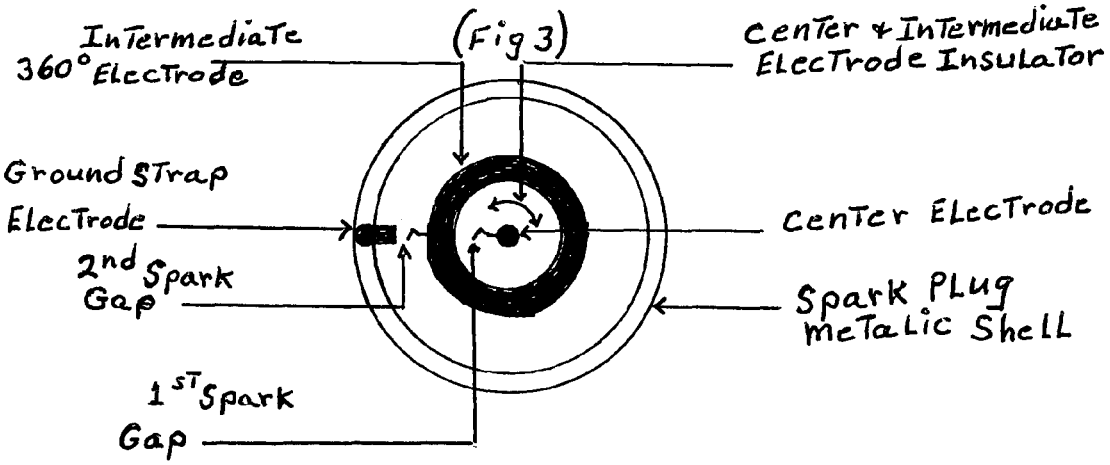

UNIQUELY DESIGNED INTERNAL COMBUSTION ENGINE SPARK PLUG THAT WILL PRODUCE TWO INDEPENDENT IGNITION SPARKS BETWEEN THE SPARK PLUG ELECTRODES FOR EACH SINGLE ELECTRICAL IGNITION COIL DISCHARGE

BACKGROUND OF THE INVENTION

This invention is a uniquely designed spark plug for use in all internal combustion engines where spark plugs are used to ignite the fuel/air mixture in the engine combustion chamber. It is well know in the industry that lean fuel/air mixtures necessary for emissions control and good fuel economy require a strong ignition system with a long spark duration. Improvements have been made in modern ignition systems related to the ignition coil and control modules but little has been done other than minor shaping of the electrodes to actually improve the spark plug ignition performance. With the use of harder metals in the spark plug electrodes and the use of multiple ground strap electrodes, the service life of modern spark plugs have been greatly extended. But, regardless of the configuration, all spark plugs currently on the market today produce only one spark at a time for each electrical discharge of the ignition coil.

This invention is a uniquely constructed spark plug designed to create two independent ignition sparks at the spark plug electrodes for each single electrical discharge of the ignition coil. The two independent sparks are electrically in series ensuring both sparks have the same electrical energy for superior ignition of the fuel/air mixture in an engine's combustion chamber thereby reducing exhaust emissions and improving engine efficiency.

BRIEF SUMMARY OF THE INVENTION

This uniquely designed spark plug incorporates an intermediate electrode that is placed between the conventional center and ground strap electrodes and is electrically insulated from the center and ground strap electrodes making it electrically neutral. The intermediate electrode so placed forms two spark air gaps. One ignition spark air gap between the center electrode and the intermediate electrode and another between the intermediate electrode and the ground strap electrode. With each single electrical discharge of the ignition coil, a spark will be emitted from the center electrode to the intermediate electrode and another from the intermediate electrode to the ground strap electrode.

The double ignition sparking of this spark plug for each single electrical discharge of the ignition coil greatly enhances ignition of the fuel air mixture in the combustion chamber. The two sparks emitted by this spark plug are physically separated therefore ignition of the fuel air mixture occurs in two places greatly improving the combustion process which reduces harmful emissions and improves engine efficiency. Because the two independent ignition sparks are electrically in series, they are of equal electrical energy with no loss of ignition spark energy in this configuration.

BRIEF DESCRIPTION OF VIEWS OF DRAWINGS

FIG. 1 depicts a spark plug as viewed from the bottom, electrode end, constructed with an intermediate electrode fixed to the center electrode insulator in the form of a round or flat or similarly shaped wire electrode forming two spark air gaps.

FIG. 2 depicts a spark plug as viewed from the bottom, electrode end, constructed with an intermediate electrode fixed to the center electrode insulator in the form of a half circle, 180 degrees or partially surrounding the center electrode forming two spark air gaps.

FIG. 3 depicts a spark plug as viewed from the bottom, electrode end, constructed with an intermediate electrode fixed to the center electrode insulator in the form of a complete circle, 360 degrees surrounding the center electrode forming two spark air gaps.

DETAILED DESCRIPTION OF THE INVENTION

This invention is an improvement to the conventional spark plug used in internal combustion engines. All spark plugs manufactured today are capable of producing only a single spark for each single electrical discharge of the ignition coil regardless of the number of spark plug electrodes used in a particular design.

This spark plug improvement invention incorporates a third intermediate electrode mounted between the center electrode of a conventional spark plug and the ground strap electrode and is configured to provide a spark air gap between the center electrode and the intermediate electrode as well as a spark air gap between the intermediate electrode and the ground strap electrode. The intermediate electrode is electrically insulated from the center electrode and the ground strap electrode making it electrically neutral. It is well known by those skilled in the science of high voltage conductivity that electrical energy will easily conduct to most electrically conductive materials without being directly referenced to the power source when electrical voltages are sufficient. Extensive tests have shown that virtually all ignition systems in use today produce sufficient secondary coil voltages, ranging from approximately 15K volts to 50K volts to readily conduct to the electrically neutral intermediate electrode once the air gap has been ionized by the ignition coil high voltage. When this happens, a spark is generated from the center electrode to the intermediate neutral electrode immediately followed by another spark from the intermediate neutral electrode to the ground strap electrode. The intermediate neutral electrode acts as an air gap conductor actually aiding conduction of the electrical energy in the form of two distinct ignition sparks.

DETAILED DESCRIPTION OF THE INVENTION-CONTINUED In extensive tests performed on this spark plug invention, no electrical spark energy loss was observed when the ignition sparks were conducted through the electrically neutral intermediate electrode.

The intermediate spark plug electrode can be fashioned as a single wire electrode between the center spark plug electrode and the ground strap electrode or as a semi-circle electrode partially encircling the center spark plug electrode or made to encircle the center spark plug electrode a full 360 degrees to provide multiple spark conduction paths to the intermediate neutral electrode.

The intermediate electrode can be made from any suitable material commonly used in spark plug electrodes that are electrically conductive such as ferrous, alloys, palladium alloys, platinum, and iridium but are not limited to those materials.

The intermediate neutral electrode is electrically insulated from the center spark plug electrode and from the ground strap electrode. The intermediate neutral electrode is connected to the extended tip center electrode insulator and becomes part of that insulator in the manufacturing process with only the electrical conduction part of the electrode left un-insulated for conduction of the ignition spark. The spark air gap will be preset in the manufacturing process at various dimensions depending on application requirements. The intermediate electrode insulator material can be insulator material commonly used in the manufacturer of spark plugs such as aluminum oxide material.

The invention claimed is:

1. An internal combustion engine igniter comprising a spark plug with an electrically neutral intermediate electrode that is both physically and electrically insulated from a spark plug's center electrode and ground strap electrode, wherein said intermediate electrode is positioned between said spark plug's center electrode and ground strap electrode forming a spark air gap between said intermediate electrode and the spark plug's center electrode and another spark air gap between said intermediate electrode and the ground strap electrode, wherein the spark plug produces two independent ignition sparks for each and every single electrical discharge of an ignition coil, wherein the intermediate electrode is affixed to a spark plug's center electrode insulator, wherein said intermediate electrode is structurally supported by the spark plug's said center electrode insulator for rigid positioning and configured so that different configurations and shapes of said intermediate electrode is physically and electrically disposed between the spark plug's center electrode and ground strap electrode, wherein said intermediate electrode as positioned forms a spark air gap between the spark plug's center electrode and said intermediate electrode and another spark air gap between the ground strap electrode and said intermediate electrode thereby providing an electrical conduction path for two distinct and separate ignition sparks in electrical series for each single electrical discharge of an ignition coil.

2. A spark plug constructed as described in claim 1 wherein said intermediate electrode is electrically insolated from the spark plug's center electrode and ground strap electrode and affixed to the spark plug to form a spark air gap between the center electrode and said intermediate electrode and another spark air gap between the ground strap electrode and said intermediate electrode, wherein said intermediate electrode embodies the form of a single wire either round or flat or similarly shaped and disposed between the spark plug's center electrode and ground strap electrode to form two separate ignition spark air gaps.

3. A spark plug constructed as described in claim 1 wherein said intermediate electrode is electrically insulated from the spark plug's center electrode and ground strap electrode and affixed to a spark plug to form a spark air gap between the center electrode and said intermediate electrode and another spark air gap between the ground strap electrode and said intermediate electrode, wherein said intermediate electrode embodies the form of an open ended ring or band or similarly shaped electrode partially surrounding the center electrode's circumference and disposed between the spark plug's center electrode and ground strap electrode to form ignition spark air gaps.

4. A spark plug constructed as described in claim 1 wherein said intermediate electrode is electrically insulated from the spark plug's center electrode and ground strap electrode and affixed to the spark plug to form a spark air gap between the center electrode and said intermediate electrode and another spark air gap between the ground strap electrode and said intermediate electrode, wherein said intermediate electrode embodies the form of a 360 degree ring or band or similarly shaped electrode completely surrounding the center electrode's circumference and disposed between the spark plug's center electrode and ground strap electrode to form ignition spark air gaps.

5. A spark plug constructed as described in claim 1 wherein said intermediate electrode is electrically insolated from the spark plug's center electrode and ground strap electrode and affixed to the spark plug to from a spark air gap between the center electrode and said intermediate electrode and another spark air gap between the ground strap electrode and said intermediate electrode, wherein said intermediate electrode can be made from any suitable conductive material comprising of ferrous alloys, platinum, iridium, palladium alloys and other bonded metallic materials but not limited to such materials.

6. A spark plug constructed as described in claim 1 wherein said intermediate electrode is electrically insulated from the spark plug's center electrode and ground strap electrode and affixed to the spark plug to form a spark air gap between the center electrode and said intermediate electrode and another spark air gap between the ground strap electrode and said intermediate electrode, wherein said intermediate electrode embodies the form of a ring or band or similarly shaped electrode with a 90 degree oroiection on said ring or band and affixed to the spark plug with said projection disposed approximately 180 degrees from the spark plug's ground strap electrode, wherein a spark air gap is formed between said intermediate electrode ring or band projection and the spark plug's center electrode and another spark air gap is formed between said intermediate electrode ring or band and the ground strap electrode thereby forming two separate ignition spark air gaps.

* * * * *

UNITED STATES PATENT AND TRADEMARK OFFICE

CERTIFICATE OF CORRECTION

PATENT NO. : 7,902,733 B2
APPLICATION NO. : 11/974593
DATED : March 8, 2011
INVENTOR(S) : Thad Whitfield Posey It is certified that error appears in the above-identified patent and that said Letters Patent is hereby corrected as shown below:

Column 2, lines 44-45, cancel the text: "DETAILED DESCRIPTION OF THE INVENTION CONTINUED."

Column 4, line 39, the term "oroiection" should be read as "projection."

Column 3, line 5, insert the following text: -- It is well known to those familiar with internal combustion engine ignition systems that ignition spark duration is one of the most significant factors in obtaining good combustion of the fuel/air mixture in the combustion chamber. The unique Double Spark, Spark Plug invention accomplishes this by producing two electrical sparks in series effectively extending the spark duration for each single electrical discharge of the ignition coil. This extended spark duration provides greater heat transfer to the fuel/air mixture to better accomplish ignition of the fuel/air mixture.

It is well established that ignition voltages typically in the range of 15K to 50K volts will readily conduct to any electrically conductive material without being directly referenced to the electrical source through electrical coupling, (electrostatic conduction). When an electrically conductive electrode (intermediate electrode) is physically placed in the ionized electrical field between the two conventional electrodes of a spark plug and connected to a high voltage inductive ignition coil, the intermediate electrode will aid in conducting electrical energy across the spark air gaps by providing a metallic electrical conduction path from the spark plug's center electrode to the ground strap electrode. When the spark plug's air gaps have been ionized, made conductive by the coil's high voltage potential, the ignition coil will electrically discharge. This discharge creates an electrical spark across the air gap between the spark plug's center electrode and intermediate electrode and immediately followed by another spark of equal electrical energy across the spark air gap between the intermediate electrode and the ground strap electrode of the Double Spark, Spark Plug, causing electrical current to flow and completing the circuit back to the ignition coil. The added intermediate electrode does two things in this configuration to improve ignition of the fuel/air mixture of an internal combustion engine. First, two distinct and separate electrical sparks are created for each single electrical discharge of the ignition coil, providing two separate ignition points in the combustion chamber to ignite the Signed and Sealed this
Fourteenth Day of June, 2011

David J. Kappos

David J. Kappos
*Director of the United States Patent and Trademark Office* fuel/air mixture. Secondly, because this configuration is a series circuit, the spark that occurs between the center electrode and the added intermediate electrode is followed in microseconds by a second spark of equal electrical energy between the added intermediate electrode and the ground strap electrode. This double sparking effectively lengthens the ignition spark duration for superior ignition of the fuel/air mixture. Ignition of the fuel/air mixture at two separated points and the lengthened ignition spark duration provided by the Double Spark, spark plug creates more complete combustion of the fuel/air mixture with an accelerated ignition flame front for higher engine efficiency and a reduction of undesirable exhaust emissions. --